US011517899B2

(12) United States Patent
Wu

(10) Patent No.: US 11,517,899 B2
(45) Date of Patent: Dec. 6, 2022

(54) MICROFLUIDIC CONTROL CHIP, MICROFLUIDIC APPARATUS, AND MANUFACTURING METHOD THEREOF

(71) Applicant: BOE TECHNOLOGY GROUP CO., LTD., Beijing (CN)

(72) Inventor: Zhihong Wu, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/469,366

(22) PCT Filed: Nov. 30, 2018

(86) PCT No.: PCT/CN2018/118527
§ 371 (c)(1),
(2) Date: Jun. 13, 2019

(87) PCT Pub. No.: WO2020/006974
PCT Pub. Date: Jan. 9, 2020

(65) Prior Publication Data

US 2022/0032291 A1 Feb. 3, 2022

(30) Foreign Application Priority Data

Jul. 2, 2018 (CN) ..... 201810708411.4

(51) Int. Cl.
*B01L 3/00* (2006.01)

(52) U.S. Cl.
CPC ... *B01L 3/502715* (2013.01); *B01L 3/502707* (2013.01); *B01L 3/502738* (2013.01);
(Continued)

(58) Field of Classification Search
CPC ..... B01L 3/502715; B01L 3/502707; B01L 3/502738; B01L 3/5027; B01L 3/502;
(Continued)

(56) References Cited

U.S. PATENT DOCUMENTS

2012/0169964 A1 7/2012 Ohyama et al.
2014/0255270 A1* 9/2014 Satsanarukkit ... B01L 3/502707 427/226

(Continued)

FOREIGN PATENT DOCUMENTS

CA 3005671 A1 5/2017
CN 103191791 A 7/2013

(Continued)

OTHER PUBLICATIONS

Xu, CN 107739706 A, English Machine Translation of Description of CN 107739706 A, obtained on Mar. 30, 2022 from espacenet.com (Year: 2022).*

(Continued)

*Primary Examiner* — Christine T Mui
(74) *Attorney, Agent, or Firm* — WHDA, LLP

(57) ABSTRACT

The disclosure relates to a microfluidic control chip. The microfluidic control chip may include an upper cover, a lower cover, and a chip functional layer between the upper cover and the lower cover. The chip functional layer may include a first region. The chip functional layer in the first region may include at least one chamber unit, an inlet flow channel to the chamber unit, and an outlet flow channel from the chamber unit. The chamber unit may include a main flow channel, a plurality of secondary flow channels, and a plurality of microcavity structures. The chamber unit may be configured to allow a liquid to flow from the main flow channel to the plurality of secondary flow channels, and then to the plurality of microcavity structures.

18 Claims, 10 Drawing Sheets

(52) U.S. Cl.
CPC ..... *B01L 2300/0636* (2013.01); *B01L 2300/0819* (2013.01); *B01L 2300/0829* (2013.01); *B01L 2300/0864* (2013.01); *B01L 2300/163* (2013.01); *B01L 2300/165* (2013.01); *B01L 2400/06* (2013.01)

(58) Field of Classification Search
CPC ..... B01L 3/50; B01L 2300/0636; B01L 2300/0819; B01L 2300/0829; B01L 2300/0864; B01L 2300/163; B01L 2300/165; B01L 2400/06
USPC ..... 422/502, 500, 50
See application file for complete search history.

(56) References Cited

U.S. PATENT DOCUMENTS

| | | | |
|---|---|---|---|
| 2017/0175067 A1* | 6/2017 | Tachibana ..... | B01L 3/502746 |
| 2018/0251831 A1 | 9/2018 | Huang et al. | |

FOREIGN PATENT DOCUMENTS

| | | | |
|---|---|---|---|
| CN | 103777398 | A | 5/2014 |
| CN | 105185266 | A | 12/2015 |
| CN | 106094231 | A | 11/2016 |
| CN | 206804900 | U | 12/2017 |
| CN | 107739706 | A | 2/2018 |
| CN | 108816300 | A | 11/2018 |
| WO | 2008/100826 | A1 | 8/2008 |

OTHER PUBLICATIONS

Office Action dated Dec. 27, 2019, issued in counterpart CN application No. 201810708411.4, with English translation. (7 pages).
International Search Report dated Mar. 15, 2019, issued in counterpart application No. PCT/CN2018/118527 (11 pages).
Office Action dated Apr. 2, 2019, issued in counterpart CN application No. 201810708411.4, with English translation (12 pages).
Office Action dated Sep. 5, 2019, issued in counterpart CN application No. 201710965088.4, with English translation. (23 pages).

* cited by examiner

MICROFLUIDIC CONTROL CHIP, MICROFLUIDIC APPARATUS, AND MANUFACTURING METHOD THEREOF

CROSS-REFERENCE TO RELATED APPLICATIONS

This application claims benefit of the filing date of Chinese Patent Application No. 201810708411.4 filed on Jul. 2, 2018, the disclosure of which is hereby incorporated in its entirety by reference.

TECHNICAL FIELD

This disclosure relates to display technology, in particular, to a microfluidic control chip, a functional apparatus, and a manufacturing method thereof.

BACKGROUND

A microfluidic control chip can integrate basic operations such as sample preparation, reaction, separation, and detection in biological, chemical, or medical analysis processes onto a micrometer-scale chip and complete the various operations as in a conventional chemical or biological laboratory.

In the prior art, the microfluidic control chip is designed to have a function of amplifying gene fragments (such as DNA, RNA). Quantitative detection of the gene fragments is realized by first amplifying the gene fragments using the microfluidic control chip.

At present, the microfluidic control chip with the function of amplifying gene fragments mainly comprises an amplification chamber. A mixture of normal gene fragments and diseased gene fragments is added to the amplification chamber for simultaneous amplification. When the number of diseased gene fragments is small, the portion of the diseased gene fragments after amplification is relatively small, thereby resulting in undetectable level of the diseased gene fragment or inaccurate quantitative detection of the diseased gene fragments.

BRIEF SUMMARY

An example of the present disclosure provides a microfluidic control chip, comprising: an upper cover, a lower cover, and a chip functional layer between the upper cover and the lower cover. The chip functional layer may include a first region. The chip functional layer in the first region may include at least one chamber unit, an inlet flow channel to the chamber unit, and an outlet flow channel from the chamber unit, the chamber unit comprising a main flow channel, a plurality of secondary flow channels, and a plurality of microcavity structures. The plurality of secondary flow channels are on both sides of the main flow channel and respectively connected to the main flow channel, and each of the plurality of microcavity structures is connected with one end of one of the secondary flow channels opposite from the main flow channel, and the chamber unit is configured to allow a liquid to flow from the main flow channel to the plurality of secondary flow channels, and then to the plurality of microcavity structures.

Optionally, the chip functional layer further comprises a second region, the chip functional layer in the second region comprises a cavity and a plurality of capture structures in the cavity, and the cavity is capable of connecting to the chamber unit through the inlet flow channel in the first region.

Optionally, a depth of the main flow channel is not greater than a depth of each of the plurality of secondary flow channels, a depth of each of the plurality of secondary flow channels is smaller than a depth of each of the plurality of microcavity structures, and the plurality of secondary flow channels are in a one-to-one correspondence with the plurality of microcavity structures.

Optionally, a width of the main flow channel is in a range of about 6 μm to about 20 μm; a width of each of the plurality of the secondary flow channels is in a range of about 0.01 μm to about 6 μm; each of the plurality of the microcavity structures is a cuboid structure, and a length of a side of a top surface of each of the plurality of the microcavity structures is about 8 μm to about 12 μm.

Optionally, a distance between a bottom surface of one of the secondary flow channels and the upper cover is in a range from about 5 μm to about 15 μm; and a distance between a bottom surface of one of the plurality of microcavity structures and the upper cover is in a range from about 10 μm to about 20 μm.

Optionally, a hydrophilic layer is provided on surfaces of the chamber unit, the inlet flow channel, and the outlet flow channel.

Optionally, a third flow channel is formed between the plurality of the capture structures and between the plurality of the capture structures and a sidewall of the cavity; a first through hole for a liquid inlet and a second through hole for a liquid outlet are provided on the sidewall of the cavity; one end of the third flow channel is connected with the first through hole, and the other end of the third flow channel is connected with the second through hole.

Optionally, a hydrophilic layer is disposed on a surface of each of the plurality of capture structures.

Optionally, a hyperbranched molecular layer composed of a hyperbranched molecular material is provided on the hydrophilic layer, and the hydrophilic layer is chemically bonded with the hyperbranched molecular material.

Optionally, a plurality of biological functional structures with a plurality of biological functional units is disposed on the hyperbranched molecular layer, and the plurality of biological functional units is bound to a plurality of branches of the hyperbranched molecular material.

Optionally, the hyperbranched molecular material is a compound having a general formula I:

I

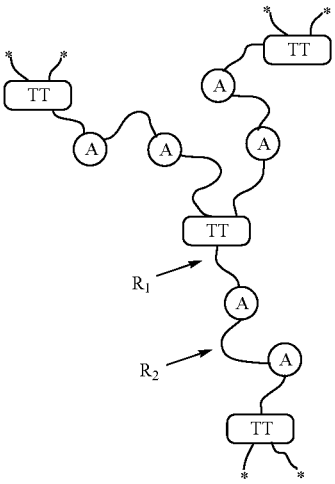

wherein TT represents an aromatic group; A represents an ester group, an amide group, an ether group or a thioether group; and R1 and R2 is a C2-C8 alkyl chain, respectively.

Optionally, the aromatic group comprises a phenyl group, a naphthyl group, a pyrenyl group or a perylene group.

Optionally, the microfluidic control chip further comprises a control valve and a liquid transfer channel, the second through hole in the second region is connected to the inlet flow channel in the first region through the control valve; and the liquid transfer channel is connected to the control valve, and the control valve is configured to control connection of the inlet flow channel to the second through hole or to the liquid transfer channel.

Optionally, the microfluidic control chip further comprises a temperature controller having a temperature control function and a temperature measurement function, wherein the temperature controller is on a surface of the lower cover opposite from the upper cover.

Another example of the present disclosure is a microfluidic apparatus, comprising the microfluidic control chip according to one embodiment of the present disclosure.

Another example of the present disclosure is a method for manufacturing a microfluidic control chip. The method may include providing a lower cover, forming a chip functional layer on the lower cover, the chip functional layer comprising a first region, and forming an upper cover on the chip functional layer. The chip functional layer in the first region comprises at least one chamber unit, an inlet flow channel, and an outlet flow channel, and the chamber unit comprises a main flow channel, a plurality of secondary flow channels, and a plurality of microcavity structures. The plurality of secondary flow channels are on both sides of the main flow channel and respectively connected to the main flow channel, and each of the plurality of microcavity structures is connected with one end of one of the secondary flow channels opposite from the main flow channel. The chamber unit is configured to allow a liquid to flow from the main flow channel to the plurality of secondary flow channels, and then to the plurality of microcavity structures.

Optionally, the chip functional layer further comprises a second region, the chip functional layer in the second region comprises a cavity and a plurality of capture structures in the cavity, and the cavity is connected to the chamber unit through the inlet flow channel in the first region.

Optionally, forming the chip functional layer on the lower cover comprises forming a hydrophilic layer on the plurality of capture structures.

Optionally, forming the chip functional layer on the lower cover further comprises forming a hyperbranched molecular layer on the hydrophilic layer, the hyperbranched molecular layer is composed of a hyperbranched molecular material, and the hydrophilic layer is chemically bonded with the hyperbranched molecular material.

Optionally, forming the chip functional layer on the lower cover further comprises forming a plurality of biological functional structures with a plurality of biological functional units on the hyperbranched molecular layer, and the plurality of biological functional units are bound to a plurality of branches of the hyperbranched molecular material.

DETAILED DESCRIPTION

Figure 1:
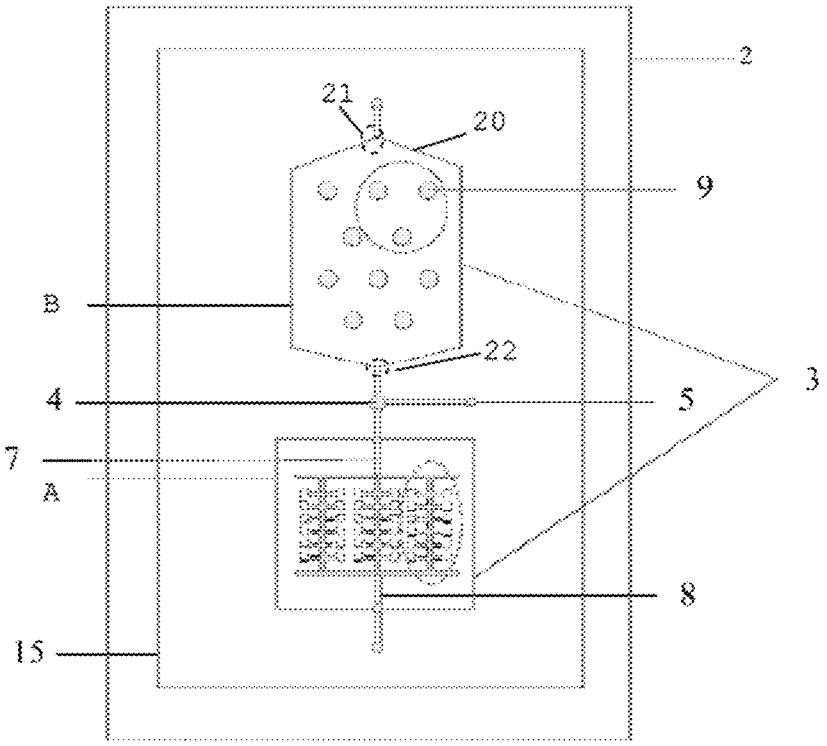
FIG. 1 is a schematic structural diagram of a microfluidic control chip according to one embodiment of the present disclosure.
Figure 2:
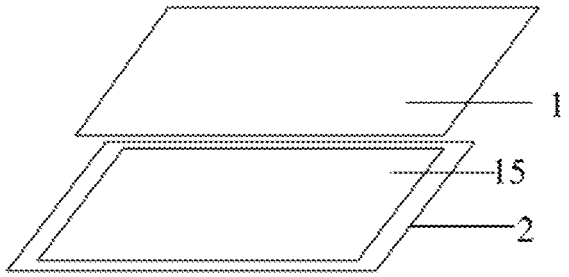
FIG. 2 is a schematic structural diagram of an upper cover and a lower cover in a microfluidic control chip according to one embodiment of the present disclosure.
Figure 3:
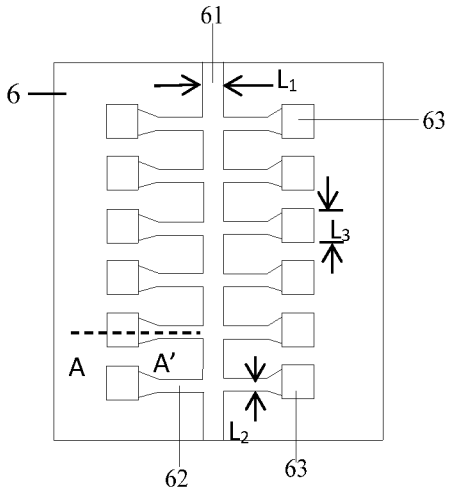
FIG. 3 is a schematic structural diagram of a chamber unit in a chip functional layer according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-11. When referring to the figures, like structures and elements shown throughout are indicated with like reference numerals. The specific embodiments of the present disclosure are described in further detail below with reference to the accompanying drawings and embodiments. The following examples are intended to illustrate the disclosure but are not intended to limit the scope of the disclosure.

In the description of the present disclosure, the meaning of "a plurality of" is two or more unless otherwise stated. The orientation or positional relationship indicated by the terms such as "upper," "lower," "left", "right," "inside," "outside," etc., are based on the orientation or positional relationship shown in the drawings, and is merely for the convenience of the description of the present disclosure, rather than indicating or implying that the machine or component referred to has a specific orientation, construction and operation, and therefore not to be construed as limiting the disclosure.

In the description of the present disclosure, it should be noted that the terms "install,", "connected to," and "coupled to" are to be understood broadly, unless otherwise explicitly defined. For example, it may be fixedly connected, or detachably connected, or integrally connected, or either mechanically connected or electrically connected. Furthermore, they may be connected directly or indirectly via an intermediate medium. The specific meaning of the above terms in the present disclosure can be understood in a specific case by those skilled in the art.

A numerical value modified by "about" herein means that the numerical value can vary by 10% thereof.

One example of the present disclosure provides a microfluidic control chip including an upper cover, a lower cover, and a chip functional layer disposed between the upper cover and the lower cover. The chip functional layer has a first area. In the first area, the chip functional layer is provided with a chamber unit, an inlet flow channel and an outlet flow channel on a surface of the chip functional layer facing the upper cover. The chamber unit includes a main flow channel, a plurality of secondary flow channels and a plurality of microcavity structures. The depth of the main flow channel is not greater than the depth of the secondary flow channel, and the depth of the secondary flow channel is smaller than the depth of the microcavity structure. The depth of the channel or microcavity structure herein refers to a distance from a surface of the chip functional layer facing the upper cover to a bottom surface of the channel or the microcavity structure respectively. The plurality of secondary flow channels are located on both sides of the main flow channel and are respectively connected to the main flow channel. The microcavity structures and the secondary flow channels are in a one-to-one correspondence arrangement. Each microcavity structure is connected with one end of a corresponding secondary flow channel opposite from the main flow channel. One end of the main flow channel in each chamber unit is connected with the inlet flow channel, and the other end of the main flow channel is connected with the outlet flow channel.

Based on the arrangement of the main flow channels, the plurality of secondary flow channels, and the plurality of microcavity structures in the chamber unit, the material flowing into the microfluidic control chip flows into the plurality of microcavity structures respectively and perform reactions in the plurality of microcavity structures respectively. When gene fragments are amplified by the microfluidic control chip provided by the embodiments of the present disclosure, the gene fragments flowing into the microfluidic control chip are divided and flowed into a plurality of microcavity structures. Due to the number of gene fragments in each microcavity structure is small, the proportion of the diseased gene fragments is relatively large after amplification of the gene fragments. Therefore, accurate quantitative detection of the diseased gene fragments can be achieved by detecting a certain amount of the gene fragments in each of the plurality of microcavity structures. The diseased gene fragments may include gene fragments of liver cancer lesions, gene fragments of lung cancer lesions, and the like.

In some embodiments, a hydrophilic layer is further provided on each of the chamber unit, the inlet flow channel, and the outlet flow channel. When the liquid flowing into the microfluidic control chip is a hydrophilic liquid, the arrangement of the hydrophilic layer reduces the contact angle between the liquid and the hydrophilic layer and increases the attraction of the liquid by the inner surface of the chip, thereby causing the liquid to flow easily into the chip. There are various types of hydrophilic layers. In one embodiment, the hydrophilic layer is a silicon dioxide layer.

The size of each structure in the microfluidic control chip can be set according to actual conditions. In some embodiments, a width of the main channel is in a range of about 6 μm to about 20 μm, and a width of the secondary flow channel is in a range of about 0.01 μm to about 6 μm. The microcavity structure is a cuboid structure, and a length of a side of a top surface of the microcavity structure is in a range of about 8 μm to about 12 μm. The top surface of the microcavity structure is disposed near the upper cover. A distance between a bottom surface of the secondary flow channel and the upper cover is about 5 to about 15 μm. A distance between a bottom surface of the microcavity structure and the upper cover is about 10 to about 20 μm.

In some embodiments, the chip functional layer provided by the embodiments of the present disclosure may further have a second area. In the second area, the chip functional layer is provided with a cavity 20 on the surface of the chip functional layer facing the upper cover and a plurality of capture structures 9 disposed in the cavity. A biological functional structure is disposed on each of the capture structures. A third flow channel is formed between the plurality of the capture structures and between the plurality of the capture structures and the sidewall of the cavity. A first through hole 21 for the liquid inlet and a second through hole 22 for the liquid outlet are provided on the sidewall of the cavity. One end of the third flow channel is connected with the first through hole 21, and the other end of the third flow channel is connected with the second through hole 22.

The chip functional layer in the second area has functions such as capturing exosomes based on the arrangement of the cavity, the capture structures, and the biological functional structures and the like. Based on the structural composition and function of the biological functional structures, the biological functional structures can be divided into several types such as a biological functional structure with a specific recognition antibody, a biological functional structure with a DNA probe, and a biological functional structure with a protein polypeptide probe, etc.

In the embodiments of the present disclosure, a hydrophilic layer may be disposed on the surface of the capture structures. As described above, the hydrophilic layer may be a silicon dioxide layer or the like. The surface of the capture structures may be covered with a hydrophilic layer. A hyperbranched molecular layer composed of a hyperbranched molecular material may be provided on the hydrophilic layer. The biological functional structure may include a plurality of biological functional units. The plurality of biological functional units is disposed on the hyperbranched molecular layer. A plurality of biological functional units is connected to a plurality of branches of the hyperbranched molecular material.

The hydrophilic layer provides hydrophilic groups, and the material of the hydrophilic layer interacts with the hyperbranched molecular material through the hydrophilic groups, so that the hyperbranched molecular material is attached to the hydrophilic layer. As a result, the hyperbranched molecular layer is fixed on the hydrophilic layer. The hyperbranched molecular material has a plurality of branches, and the plurality of branches provide a plurality of sites connecting to the plurality of biological functional units. As such, a larger number of biological functional units are connected to the hyperbranched molecular material, thereby improving the biological functional properties of the structure, such as the ability of the structure to capture antigen and antibodies, which is conducive to obtain more accurate experimental data.

The microfluidic control chip provided by some embodiments of the disclosure may further include a control valve and a liquid transfer flow channel, wherein the second through hole located in the second region is connected to the inlet of the inlet flow channel located in the first region through the control valve. The liquid transfer channel is connected to the control valve.

In the embodiments, the chip functional layer in the first region is connected to the chip functional layer in the second region based on the control valve, the liquid transfer channel, the first through hole, the second through hole, and the like, so that the liquid after processed by the second region can flow into the first region, and further processed by the chip functional layer in the first region. As such, one microfluidic control chip can have two processing functions.

The microfluidic control chip provided by the embodiments of the disclosure may further comprise a temperature control apparatus having a temperature control function and a temperature measurement function. The temperature control apparatus may be disposed on a surface of the lower cover opposite from the upper cover. The temperature control apparatus enables the microfluidic control chip to have an automatic temperature measurement function and a temperature control function, which can accurately control the reaction temperature inside the chip and make timely adjustments, thereby enriching the function of the microfluidic control chip and improving accuracy of the chip response.

The microfluidic control chip provided by the embodiments of the present disclosure will be described in detail through the following embodiments.

In some embodiments, as shown in FIGS. 1 to 4, the microfluidic control chip includes an upper cover 1, a lower cover 2, a chip functional layer 3 between the upper cover 1 and the lower cover 2, a control valve 4, and a liquid transfer channel 5.

In some embodiments, the chip functional layer 3 has a first region A and a second region B. The chip functional layer 3 located in the first region A has a function of amplifying gene fragments, and the chip functional layer 3 located in the second region B has a function of capturing and lysing exosomes.

In some embodiments, in the first region A, the chip functional layer 3 is provided with a plurality of chamber units 6, an inlet flow channel 7 and an outlet flow channel 8 on the surface of the chip functional layer facing the upper cover 1. Each of the chamber units 6 includes a main flow channel 61, a plurality of secondary flow channels 62 and a plurality of microcavity structures 63. The depth of the main flow channel 61 is smaller than the depth of the secondary flow channel 62, and the depth of the secondary flow channel 62 is smaller than the depth of the microcavity structure 63. The plurality of secondary flow channels 62 is located on the two sides of the main flow channel 61 and respectively connected to the main flow channel 61. The microcavity structures 63 are disposed in one-to-one correspondence with the secondary flow channels 62, and each of the microcavity structures 63 is connected with one end of the corresponding secondary flow channel 62 opposite from the main flow channel 61. One end of the main flow channel 61 in each of the chamber units 6 is connected with the inlet flow channel 7, and the other end of the main flow channel 61 is connected with the outlet flow channel 8.

Figure 4:
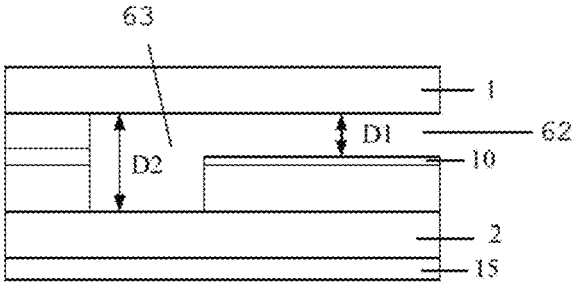
FIG. 4 is a cross-sectional view showing the structure of the chamber unit along line AA' shown in FIG. 3.

In some embodiments, the structure in the first region A of the chip functional layer 3 has the following dimensions: a width of the main flow channel 61 L1 is about 8 μm and a width of the secondary flow channel 62 L2 is about 4 μm. The microcavity structure has a cuboid structure, and a top surface of the microcavity structure may be a square. The top surface of the microcavity structure is disposed near the upper cover, and a length of a side of the top surface L3 is about 10 μm. As shown in FIG. 4, a distance D1 between a bottom surface of the secondary flow channel 62 and the upper cover 1 is about 10 μm, and a distance D2 between a bottom surface of the microcavity structure 63 and the upper cover 1 is about 15 μm.

In some embodiments, a silicon dioxide layer 10 is disposed on each surface of the structures in the first region A of the microfluidic control chip.

The gene fragments and other substance for the amplification may be subjected to an amplification process using the chip functional layer 3 in the first region A. The materials to be amplified enter the first region A and are distributed in the plurality of microcavity structures 63 through the main flow channel 61 and the secondary flow channels 62. The distributed materials to be amplified are separately amplified in the microcavity structures 63 in which they are located.

The size and number of materials to be amplified flowing into each microcavity structure 63 can be controlled by controlling the reaction conditions. In some embodiments, when the material to be amplified is RNA or DNA, based on the size of each structure in the first region A, the concentration of the RNA or DNA sample solution flowing into the main flow channel 61 can be controlled to be about 10 to about 20 ng/mL, and the flow rate of the sample solution can be controlled to be about 45 to about 55 μm/s. As such, only one RNA strand or one DNA strand may flow into each microcavity structure 63, so that a single RNA strand or a single DNA strand is amplified in the microcavity structure 63, thereby further improving the accurate quantitative detection of diseased gene fragments.

In some embodiments, in the second region B, as shown in FIG. 5 to FIG. 8, the chip functional layer 3 is provided with a cavity 20 on the surface of the chip functional layer facing the upper cover 1. The cavity 20 penetrates through the chip functional layer 3, and a plurality of capture structures 9 are arranged in the cavity 20. Each capture structure 9 is covered with a silicon dioxide layer 10. The silicon dioxide in the silicon dioxide layer 10 is connected to hyperbranched molecular materials to form a hyperbranched molecular layer 11 on the silicon dioxide layer 10. Further, the hyperbranched molecular material is linked to the biological functional structure 12. In one embodiment, the biological functional structure 12 may include streptavidin 121, biotin 122, and a specific recognition antibody 123. The hyperbranched molecular material is linked to a streptavidin 121 by a specified functional group 111, the streptavidin 121 is linked to a biotin 122, and the biotin 122 is linked to a specific recognition antibody 123. The specific recognition antibody 123 binds to an antigen of a target exosome 13, and attaches the target exosome 13 to the capture structure 9, thereby achieving capture of the target exosome 13. A fluorescent labeled antigen/antibody 14 then binds to the designated deceased antibody/antigen in the target exosome 13, thereby achieving fluorescent labeling of diseased exosomes.

In some embodiments, a third flow channel is formed between the plurality of capture structures 9 and the side wall of the cavity. A first through hole for the liquid inlet and a second through hole for the liquid outlet are provided on the side wall of the cavity. One end of the third flow channel is connected with the first through hole, and the other end of the third flow channel is connected with the second through hole.

Figure 5:
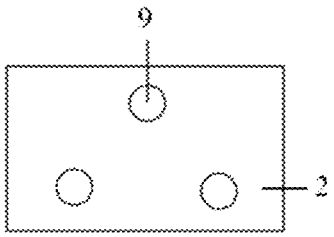
FIG. 5 is a schematic structural diagram of a capture structure in a chip functional layer according to one embodiment of the present disclosure.
Figure 6:
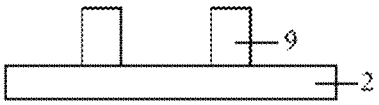
FIG. 6 is a side view showing the structure of the capture structure shown in FIG. 5.
Figure 7:
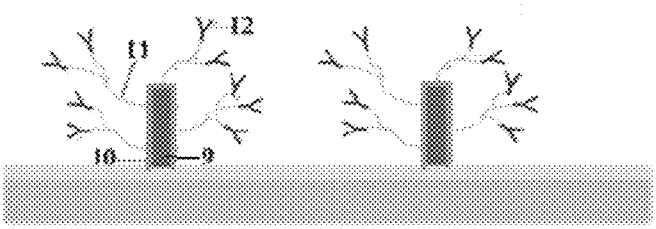
FIG. 7 is a schematic structural diagram of a hyperbranched molecular layer and a biological functional structure in a chip functional layer according to one embodiment of the present disclosure.
Figure 8:
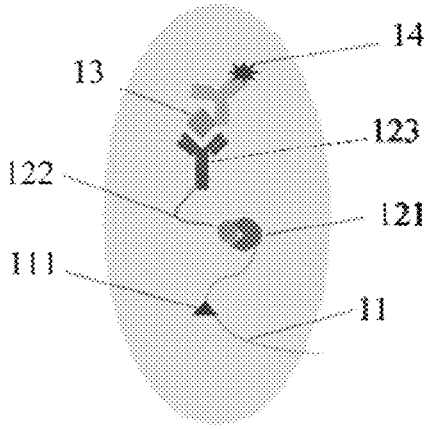
FIG. 8 is a schematic diagram showing the combination of the biological functional structure and the target exosomes shown in FIG. 7.

In one embodiment, the capture structures 9 may be integrally formed with the cavity of the chip functional layer 3 to reduce the number of processing steps. The parameters such as the structure and number of the capture structures 9 can be set according to actual conditions. FIGS. 5 and 6 are enlarged views of the structure in the second region according to some embodiments of the present disclosure. The capture structure 9 shown in FIGS. 5 and 6 has a cylindrical structure, and a plurality of cylindrical capture structures 9 are spaced apart in the cavity.

In some embodiments, in FIG. 5 and FIG. 6, a height of the capture structure 9 is about 40 μm, and a spacing between adjacent capture structures 9 is about 200 μm. In a side view shown in FIG. 6, a distance between the two capture structures 9 is about 150 μm and the circular top surface of the capture structure 9 has a diameter of about 50 μm. The capture structure layer 9 is provided with a silicon dioxide layer 10. Generally, the silicon dioxide layer 10 is very thin, and a thickness thereof is in the order of nanometers, which is much smaller than the thickness of other structures. The thickness of the silicon dioxide layer 10 can be set as needed.

The embodiments of the present disclosure provide a novel hyperbranched molecular material. In one embodiment, the novel hyperbranched molecular material includes a compound having the following formula I;

I

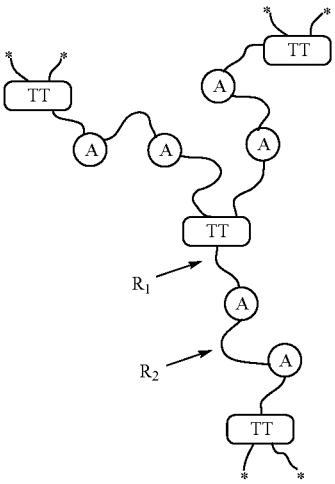

Wherein T represents an aromatic group; A represents an ester group, an amide group, an ether group or a thioether group; R1 is a C2-C8 alkyl chain, and R2 is a C2-C8 alkyl chain, respectively. The aromatic group represented by TT may be, for example, a phenyl group, a naphthyl group, a pyrenyl group or a perylene group, etc., which can be set according to actual conditions.

In one embodiment, based on the structure of the compound of formula I, after attaching the compound of formula I to the silica layer 10, the compound of formula I is further linked to the streptavidin by its amino functional group.

In one embodiment, the second through hole located in the second region B is connected to the inlet of the inlet flow channel 7 located in the first region A through the control valve 4. The liquid transfer channel 5 is connected to the control valve 4. By controlling the control valve 4, the connection between the outlet flow channel 8 in the first region A and the liquid transfer channel 5 can be realized, and the connection between the outlet flow channel 8 in the first region A and the second through hole located in the second region B can be realized.

In some embodiments, a temperature control apparatus 15 is further provided on a side of the lower cover opposite from the upper cover, and the temperature control apparatus 15 is used for temperature detection and temperature control.

Some embodiments of the present disclosure also provide a functional apparatus comprising the microfluidic control chip provided by any one of the above embodiments of the present disclosure. The functional apparatus has many advantages of the microfluidic control chip, and the details thereof are not described herein again.

Figure 9:
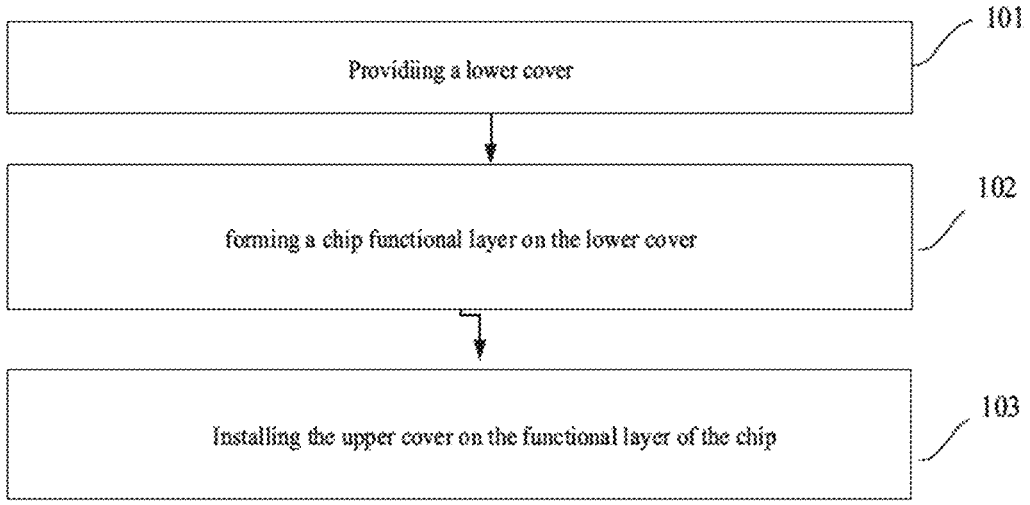
FIG. 9 is a flowchart of a method for fabricating a microfluidic control chip according to one embodiment of the present disclosure.

Some embodiments of the present disclosure further provide a method for fabricating a microfluidic control chip according to any one of the above embodiments of the present disclosure. Referring to FIG. 9, a method for manufacturing a microfluidic control chip comprises the following:

Step 101 includes providing a lower cover.

A lower cover with a specified size is provided. The lower cover may be a cover made of glass or a cover made of other suitable materials.

Step 102 includes forming a chip functional layer on the lower cover by a patterning process. In some embodiments, the step may include forming chamber units, an inlet flow channel and an outlet flow channel in the first region of the chip functional layer. The chamber unit may include a main flow channel, a plurality of secondary flow channels, and a plurality of microcavity structures. A depth of the main flow channel is not greater than a depth of the secondary flow channel, and a depth of the secondary flow channel is smaller than a depth of the microcavity structure. The plurality of secondary flow channels are located on both sides of the main flow channel and are respectively connected to the main flow channel. The microcavity structures and the secondary flow channels are in a one-to-one correspondence. Each microcavity structure is connected with one end of the corresponding secondary flow channel opposite from the main flow channel. One end of the main flow channel in each chamber unit is connected with the inlet flow channel, and the other end of the main flow channel is connected with the outlet flow channel. Through the above steps, a chip functional layer may be formed on the lower cover.

Step 103 includes installing the upper cover on the functional layer of the chip.

After fabrication of the chip functional layer is completed, an upper cover is mounted on the chip functional layer, and the chip functional layer is sandwiched between the upper cover and the lower cover. The upper and lower covers can then be encapsulated by a process such as an encapsulation process.

Based on the foregoing description of the chip functional layer, the chip functional layer can have both the first region and the second region. When the chip functional layer has both the first region and the second region, the step of forming the chip functional layer on the lower substrate by the patterning process may further includes forming, by the patterning process, a cavity in the second region of the chip functional layer and a plurality of capture structures located in the cavity. A third flow channel is formed between the plurality of capture structures and the sidewall of the cavity. The first through hole for the liquid inlet and the second through hole for the liquid outlet are provided on the sidewall of the cavity. One end of the third flow channel is connected with the first through hole, and the other end of the third flow channel is connected with the second through hole.

In some embodiments, after forming the cavity and a plurality of capture structures located in the cavity in the second region of the chip functional layer by a patterning process, the method may further includes forming a hydrophilic layer on the capture structures. In some embodiments, correspondingly, after the upper cover is mounted on the chip functional layer, the method may further include placing the hyperbranched molecular materials in the second region of the chip functional layer of the microfluidic control chip, and forming a hyperbranched molecular layer on the hydrophilic layer. The biological functional material is then placed in the second region of the chip functional layer to form a biological functional structure on the hyperbranched molecular layer.

In some embodiments, the biological functional structure may include a plurality of biological functional units. The hyperbranched molecular material has a plurality of branches and provides a plurality of sites for binding to the biological functional units. As such, a greater number of biological functional units can be connected to the hyperbranched molecular material, thereby improving the biological function of the structure such as improved ability to capture antigen/antibody by the structure, which facilitates obtaining accurate test data.

Figure 10:
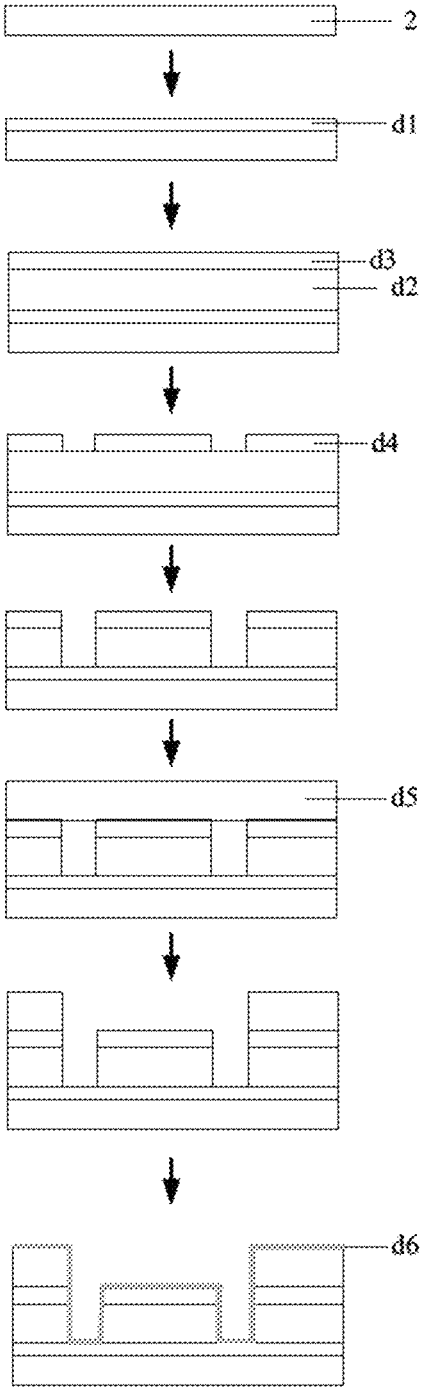
FIG. 10 is a process flow diagram of fabricating a microfluidic control chip according to one embodiment of the present disclosure.

The method for fabricating the microfluidic control chip provided by the embodiments of the present disclosure is described in detail below in conjunction with the structure of the microfluidic control chip provided by the embodiment of the present disclosure. Referring to FIG. 10, a method for fabricating a microfluidic control chip includes the following steps:

Step 1 includes selecting a glass substrate as a lower cover 2, cleaning the glass substrate, and spin-coating a layer of adhesive, that is, an OC layer d1, on the cleaned glass substrate.

In some embodiments, the specific operating conditions of this step are as follows: a piece of white glass is taken, and the adhesive solution is spin-coated at a speed of 1500 r/min for 45 s to form an OC layer d1, followed by curing at 230° C. for 30 minutes. The thermally cured substrate was spin-coated with a thick film-processable adhesive, and the spin coating speed was 300 r/min. After the spin coating was completed, the film was dried at 230° C. for 30 minutes to form an adhesive layer d2 having a thickness of about 10 μm.

Step 2 includes using a plasma-enhanced chemical vapor deposition (PECVD) process to form a silicon dioxide layer d3 on the adhesive layer d2, and the thickness of the silicon dioxide layer d3 is about 300 mu.

Step 3 includes patterning the silicon dioxide layer d3 to obtain a patterned silicon dioxide layer d4.

There are various ways of patterning the silicon dioxide layer d3, for example, by photolithography, etching, and the like.

Step 4 includes patterning the adhesive layer d2 by a pure oxygen dry etching technique using the patterned silicon dioxide layer d4 as a mask. The part of the adhesive layer d2 corresponding to hollow regions of the patterned silicon dioxide layer d4 is removed.

Step 5 includes spin-coating a photoresist layer d5 on the surface of the structure obtained in the step 4, and exposing the surface through the mask to remove the exposed area of the photoresist layer d5, thereby obtaining a desired microcavity structure, flow channels, and an cavity, capture structures and other structures.

Step 6 includes forming a hydrophilic silicon dioxide layer d6 on the surface of the structure obtained in the step 5.

Step 7 includes placing the upper cover on the structure obtained in step 6. The region where the microcavity structure and the flow channels are located is the first region, and the region where the cavity and the capture structures are located is the second region.

Step 8 includes grafting the pre-prepared hyperbranched molecular material onto the silicon dioxide-covered capture structure (microcolumn) through a methanol solution to form a hyperbranched molecular layer on the capture structures. After the reaction is completed, the outlet flow channel of the first region is connected with the liquid transfer channel by rotating the control valve, and the residual liquid after the reaction flows out from the liquid transfer channel.

Step 9 includes placing a phosphate buffered streptavidin (PBS) solution in the second region, and an incubation reaction is carried out at room temperature for 3 minutes, so that the amino acids of the hyperbranched molecular material of the hyperbrauched molecular layer and the streptavidin form covalent bonds. Then, the second region is washed three times with deionized water and dried with nitrogen.

Step 10 includes, by using a spotting apparatus, spotting the PBS solution with the biotin-specific recognition antibody on the surface of the lower substrate, that is, the glass substrate, and incubating the PBS solution at 4° C. overnight. As such, the biotin is linked to streptavidin, thereby obtaining a glass-based chip with biochemical function. Surface modification effects and biochemical inoculation effect can be characterized by techniques such as EDX, XPS, contact angle and total reflection FTIR.

The second region in which the cavity and the capture structures are located has a capture and lysis function, and the cavity corresponding to the second region is a capture cavity. The first region having the chamber units, the main flow channels, and the secondary flow channels has the function of reverse transcription of RNA and amplification of RNA. The chamber corresponding to the first region is an amplification chamber.

Before performing step 8, it is necessary to synthesize a hyperbranched molecular material in advance. Some embodiments of the present disclosure provide a novel hyperbranched molecular material having the structure represented by the above formula I, and a method for synthesizing a hyperbranched molecular material having the structure represented by the general formula I.

Figure 11:
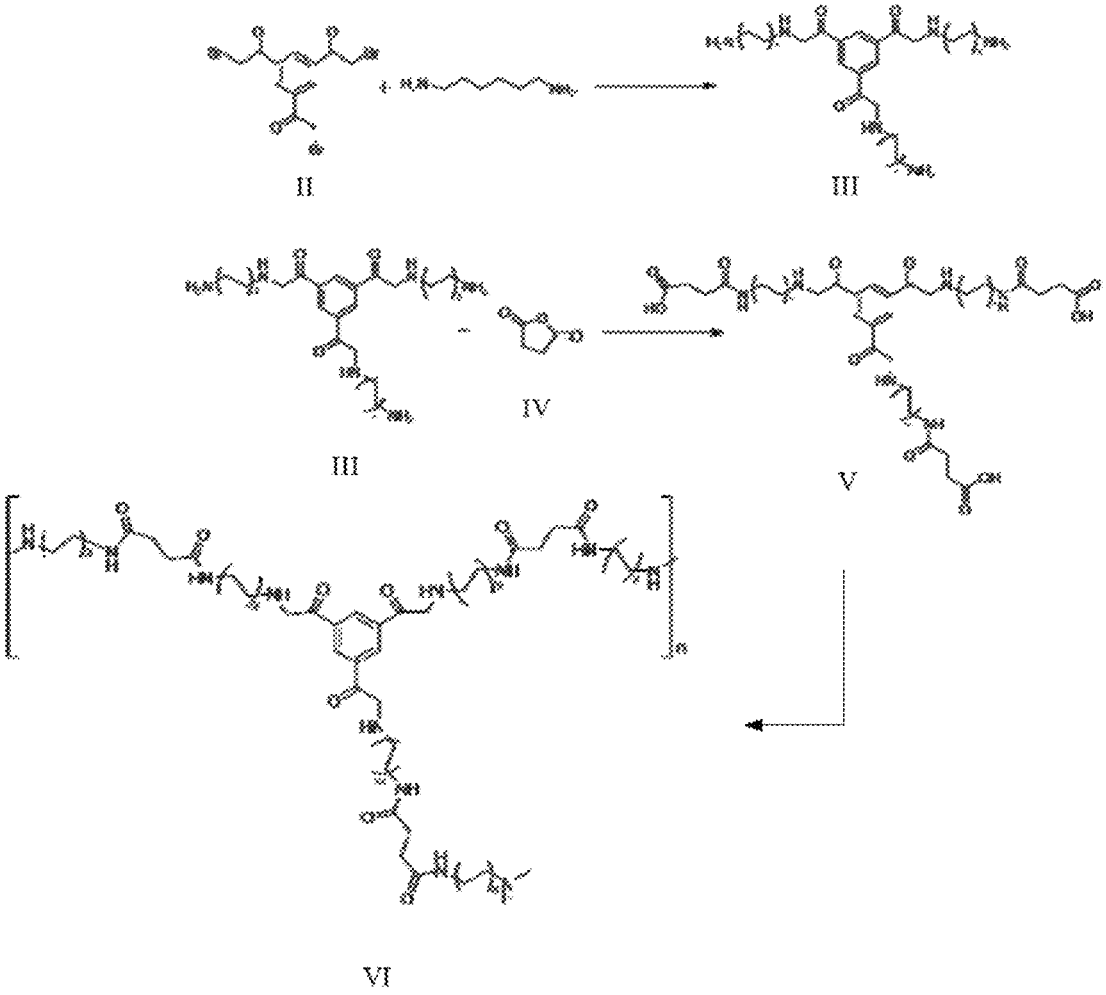
FIG. 11 is a synthetic route diagram of a hyperbranched molecular material according to one embodiment of the present disclosure.

In one embodiment, the present disclosure exemplifies a method for synthesizing a hyperbranched molecular material provided by the present disclosure with reference to the synthetic route diagram shown in FIG. 11. As shown in FIG. 11, the synthesis method comprises the steps of: first, obtaining monomer II; second, reacting monomer II with hexamethylenediamine to obtain monomer III; then, reacting monomer III with monomer IV to obtain a monomer V; and finally, the hexamethylenediamine is reacted with the monomer V to obtain a hyperbranched molecular material having the structural formula VI. The structural formula VI conforms to the general formula I.

The reaction conditions of each reaction step can be set according to actual conditions. In one embodiment, after monomer II is obtained, 5 mmol of monomer II and hexamethylenediamine are respectively used. In one embodiment, 5 mmmol of monomer II and 5 mmol of hexamethylenediamine are dissolved in 20 mL of tetrahydrofuran and 30 mL of ethanol, and a reaction was carried out at room temperature for 5 h to obtain a monomer III. The obtained monomer III and monomer IV were reacted in methanol to obtain a monomer V.

The ratio of the amount of each material and the reaction conditions can be set according to actual needs to obtain a hyperbranched molecular material having a specified size and a desired molecular weight.

The microfluidic control chip produced by the embodiment of the present disclosure can be used for exosome capture, exosome lysis, RNA reverse transcription, DNA amplification and the like. The above various operations of the microfluidic control chip according to some embodiments of the present disclosure will now be described in detail by the following description.

Capturing Target Exosomes:

In one embodiment, the control valve of the microfluidic control chip is controlled such that the capture chamber is connected with the liquid transfer flow channel. The sample solution including the target exosomes is introduced into the capture chamber through the liquid transfer flow channel. The target exosome in the sample solution is bound through the antigen on the target exosome to a specific recognition antibody on the capture structure in the second region to achieve capture of the target exosome by the capture structures. After the capture is completed, the remaining liquid flows out of the liquid transfer channel by controlling the control valve.

Fluorescently Labeling Target Exosomes:

In one embodiment, by controlling the control valve, the fluorescently labeled specific antigen/antibody is flowed into the capture chamber from the first through hole. By specific identification of the antigen/antibody, the fluorescently labeled specific antigen/antibody is bound with the designated antibody on the target exosomes to achieve fluorescent labeling of the target exosome. Whether or not the target exosomes were captured was observed by immunolabeling fluorescence.

Lysing the Target Exosomes:

The capture chamber is connected to the amplification chamber by controlling the control valve. By the first through hole of the chamber, a lysate solution is input into the capture chamber. After the lysate solution contacts the target exosomes on the capture structure, the vesicles of the target exosomes are cleaved, and the internal RNAs are released. The RNAs pass through the second hole to flow into the amplification chamber and are distributed in a plurality of microcavity structures.

RNA Reverse Transcription and DNA Amplification:

The reagents required for reverse transcription of RNAs are added to the amplification chamber such that the RNAs are reverse transcribed into DNAs in the microcavity structures. The reaction conditions for RNA reverse transcription can be set based on the reagents.

The reagents required for DNA amplification are added to the amplification chamber to allow amplification of the DNA in the microcavity structures. The reaction conditions for DNA amplification can be set according to the reagents. For example, in one embodiment, the flow channels and microcavity structures are heated at 95° C. for 3 min, and then the flow channels and microcavity structures are heated at 60° C. for 30 s. The above heating operation is used as a heating cycle to heat the DNA amplification process to achieve DNA amplification. The amplified DNA can flow out of the outlet flow channel of the amplification chamber. The obtained DNA segments can be used for subsequent gene sequencing or genotyping analysis and the like.

Some embodiments of the disclosure provide a microfluidic control chip, a functional apparatus and a manufacturing method thereof. The microfluidic control chip includes an upper cover, a lower cover and a chip functional layer. The first region of the chip functional layer is provided with a chamber unit, an inlet flow channel and an outlet flow channel. Based on the arrangement of the main flow channels, the plurality of secondary flow channels, and the plurality of microcavity structures in the chamber unit, the material flowing into the microfluidic control chip flows into the plurality of microcavity structures to perform reactions within the plurality of microcavity structures. When gene fragments are amplified by using the microfluidic control chip provided by the embodiment of the present disclosure, the gene fragments flowing into the microfluidic control chip are divided into a plurality of microcavity structures. Because the number of gene fragments in the microcavity structure is small, the proportion of the diseased gene fragments is relatively large after the amplification of the gene fragments. Therefore, the quantitative detection of the gene fragments in the plurality of microcavity structures can be performed, and the diseased gene fragments can be detected quickly and accurately, thereby realizing accurate quantitative detection of the diseased gene fragments.

The principle and the embodiment of the present disclosures are set forth in the specification. The description of the embodiments of the present disclosure is only used to help understand the method of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure (but not limited to) with similar features.

DESCRIPTION OF THE REFERENCE NUMERALS 1, the upper cover; 2, the lower cover; 3, the chip functional layer; 4, the control valve; 5, liquid transfer channel; 6, chamber unit; 61, main flow channel; 62, secondary flow channel; 63, microcavity structure; 7, inlet flow channel; 8, outlet flow channel; 9, capture structure; 10, silicon dioxide layer; 11, hyperbranched molecular layer; 111, designated functional group; 12, biological functional structure; 121, streptavidin; 122, biotin; 123, specific recognition antibody; 13, target exosome; 14, fluorescent labeled specific antigen/antibody; 15, temperature control apparatus; d1, OC layer; d2, adhesive layer; d3, silicon dioxide layer; d4, patterned silicon dioxide layer; d5, photoresist layer; d6, silicon dioxide layer; A, first region; B, second region; D1, the distance between the flow channel and the upper cover; D2, the distance between the bottom surface of the microcavity structure and the upper cover.

What is claimed is:

1. A microfluidic control chip, comprising: an upper cover, a lower cover, and a chip functional layer between the upper cover and the lower cover, the chip functional layer comprising a first region, the chip functional layer in the first region comprising at least one chamber unit, an inlet flow channel to the chamber unit, and an outlet flow channel from the chamber unit, the chamber unit comprising a main flow channel, a plurality of secondary flow channels, and a plurality of microcavity structures, wherein the plurality of secondary flow channels are on both sides of the main flow channel and respectively connected to the main flow channel, and each of the plurality of microcavity structures is connected with one end of one of the secondary flow channels opposite from the main flow channel, and the chamber unit is configured to allow a liquid to flow from the main flow channel to the plurality of secondary flow channels, and then to the plurality of microcavity structures; and wherein a hydrophilic layer is provided on surfaces of the chamber unit, the inlet flow channel, and the outlet flow channel.

2. The microfluidic control chip of claim 1, wherein the chip functional layer further comprises a second region, the chip functional layer in the second region comprises a cavity and a plurality of capture structures in the cavity, and the cavity is capable of connecting to the chamber unit through the inlet flow channel in the first region.

3. The microfluidic control chip of claim 2, wherein a depth of the main flow channel is not greater than a depth of each of the plurality of secondary flow channels, a depth of each of the plurality of secondary flow channels is smaller than a depth of each of the plurality of microcavity structures, the plurality of secondary flow channels are in a one-to-one correspondence with the plurality of microcavity structures.

4. The microfluidic control chip according to claim 2, wherein a width of the main flow channel is in a range of about 6 μm to about 20 μm; a width of each of the plurality of the secondary flow channels is in a range of about 0.01 μm to about 6 μm; each of the plurality of the microcavity structures is a cuboid structure, and a length of a side of a top surface of each of the plurality of the microcavity structures is about 8 μm to about 12 μm.

5. The microfluidic control chip of claim 2, wherein a distance between a bottom surface of one of the secondary flow channels and the upper cover is in a range from about 5 μm to about 15 μm; and a distance between a bottom surface of one of the plurality of microcavity structures and the upper cover is in a range from about 10 μm to about 20 μm.

6. A microfluidic control chip, comprising: an upper cover, a lower cover, and a chip functional layer between the upper cover and the lower cover, the chip functional layer comprising a first region, the chip functional layer in the first region comprising at least one chamber unit, an inlet flow channel to the chamber unit, and an outlet flow channel from the chamber unit, the chamber unit comprising a main flow channel, a plurality of secondary flow channels, and a plurality of microcavity structures, wherein the plurality of secondary flow channels are on both sides of the main flow channel and respectively connected to the main flow channel, and each of the plurality of microcavity structures is connected with one end of one of the secondary flow channels opposite from the main flow channel, and the chamber unit is configured to allow a liquid to flow from the main flow channel to the plurality of secondary flow channels, and then to the plurality of microcavity structures;

wherein the chip functional layer further comprises a second region, the chip functional layer in the second region comprises a cavity and a plurality of capture structures in the cavity, and the cavity is capable of connecting to the chamber unit through the inlet flow channel in the first region;

wherein a third flow channel is formed between the plurality of the capture structures and between the plurality of the capture structures and a sidewall of the cavity; a first through hole for a liquid inlet and a second through hole for a liquid outlet are provided on the sidewall of the cavity; one end of the third flow channel is connected with the first through hole, and the other end of the third flow channel is connected with the second through hole; and wherein a hydrophilic layer is disposed on a surface of each of the plurality of capture structures.

7. The microfluidic control chip of claim 6, wherein a hyperbranched molecular layer composed of a hyperbranched molecular material is provided on the hydrophilic layer, and the hydrophilic layer is chemically bonded with the hyperbranched molecular material.

8. The microfluidic control chip of claim 7, wherein a plurality of biological functional structures with a plurality of biological functional units are disposed on the hyperbranched molecular layer, and the plurality of biological functional units are bound to a plurality of branches of the hyperbranched molecular material.

9. The microfluidic control chip of claim 7, wherein the hyperbranched molecular material is a compound having a general formula I;

I

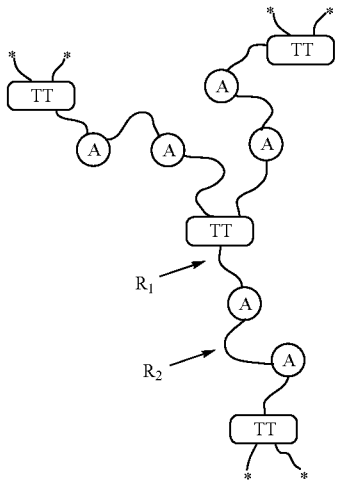

wherein TT represents an aromatic group; A represents an ester group, an amide group, an ether group or a thioether group; and R1 and R2 is a C2-C8 alkyl chain, respectively.

10. The microfluidic control chip of claim 9, wherein the aromatic group comprises a phenyl group, a naphthyl group, a pyrenyl group or a perylene group.

11. The microfluidic control chip of claim 6, further comprising a control valve and a liquid transfer channel;

wherein the second through hole in the second region is connected to the inlet flow channel in the first region through the control valve; and the liquid transfer channel is connected to the control valve, and the control valve is configured to control connection of the inlet flow channel to the second through hole or to the liquid transfer channel.

12. The microfluidic control chip of claim 1, further comprising a temperature controller having a temperature control function and a temperature measurement function, wherein the temperature controller is on a surface of the lower cover opposite from the upper cover.

13. A microfluidic apparatus, comprising the microfluidic control chip of claim 1.

14. A method for manufacturing a microfluidic control chip, the method comprising:

providing a lower cover;

forming a chip functional layer on the lower cover, the chip functional layer comprising a first region, and forming a upper cover on the chip functional layer, wherein the chip functional layer in the first region comprises at least one chamber unit, an inlet flow channel, and an outlet flow channel, and the chamber unit comprises a main flow channel, a plurality of secondary flow channels, and a plurality of microcavity structures, wherein the plurality of secondary flow channels are on both sides of the main flow channel and respectively connected to the main flow channel, and each of the plurality of microcavity structures is connected with one end of one of the secondary flow channels opposite from the main flow channel, and wherein the chamber unit is configured to allow a liquid to flow from the main flow channel to the plurality of secondary flow channels, and then to the plurality of microcavity structures; and wherein a hydrophilic layer is provided on surfaces of the chamber unit, the inlet flow channel, and the outlet flow channel.

15. The method for manufacturing the microfluidic control chip of claim 14, wherein the chip functional layer further comprises a second region, the chip functional layer in the second region comprises a cavity and a plurality of capture structures in the cavity, and the cavity is connected to the chamber unit through the inlet flow channel in the first region.

16. The method for manufacturing the microfluidic control chip of claim 15 wherein forming the chip functional layer on the lower cover comprises forming a second hydrophilic layer on the plurality of capture structures.

17. The method for manufacturing the microfluidic control chip of claim 16, wherein forming the chip functional layer on the lower cover further comprises forming a hyperbranched molecular layer on the second hydrophilic layer, the hyperbranched molecular layer is composed of a hyperbranched molecular material, and the second hydrophilic layer is chemically bonded with the hyperbranched molecular material.

18. The method for manufacturing the microfluidic control chip of claim 17, wherein forming the chip functional layer on the lower cover further comprises forming a plurality of biological functional structures with a plurality of biological functional units on the hyperbranched molecular layer, and the plurality of biological functional units are bound to a plurality of branches of the hyperbranched molecular material.

* * * * *